US006078774A

United States Patent [19]

Kim et al.

[11] Patent Number: 6,078,774

[45] Date of Patent: Jun. 20, 2000

[54] TRANSFER UNIT OF ELECTROPHOTOGRAPHIC PRINTER

[75] Inventors: Jeong-Hoon Kim; Cheol-Young Han; Moon-Bae Park, all of Suwon, Rep. of Korea

[73] Assignee: SamSung Electronics Co., Ltd., Suwon, Rep. of Korea

[21] Appl. No.: 09/390,626

[22] Filed: Sep. 7, 1999

[30] Foreign Application Priority Data

Sep. 19, 1998 [KR] Rep. of Korea ..... 98/38827

[51] Int. Cl.[7] ..... G03G 15/16; G03G 15/20; G03G 15/24

[52] U.S. Cl. ..... 399/307; 399/302; 399/308; 492/46

[58] Field of Search ..... 399/307, 302, 399/308; 492/1–3, 6, 7, 46, 56

[56] References Cited

U.S. PATENT DOCUMENTS 5,195,430 3/1993 Rise ..... 100/168
5,689,788 11/1997 Moser ..... 399/328

*Primary Examiner*—Richard Moses
*Attorney, Agent, or Firm*—Robert E. Bushnell, Esq.,

[57] ABSTRACT

A transfer unit of an electrophotographic printer includes: a transfer roller and a fuser roller for transferring an image onto the paper. One of the two rollers has a shape having flared ends and a smaller diameter at the center portion thereof and the other roller has a core portion having a crowned shape mating with the shape of the flared roller and a deformable portion which is provided around the core portion so as to form a circumferential surface having a straight profile line, and which is deformable so that a uniform gap between the two rollers is formed.

8 Claims, 3 Drawing Sheets

FIG. 1 *(Related Art)*
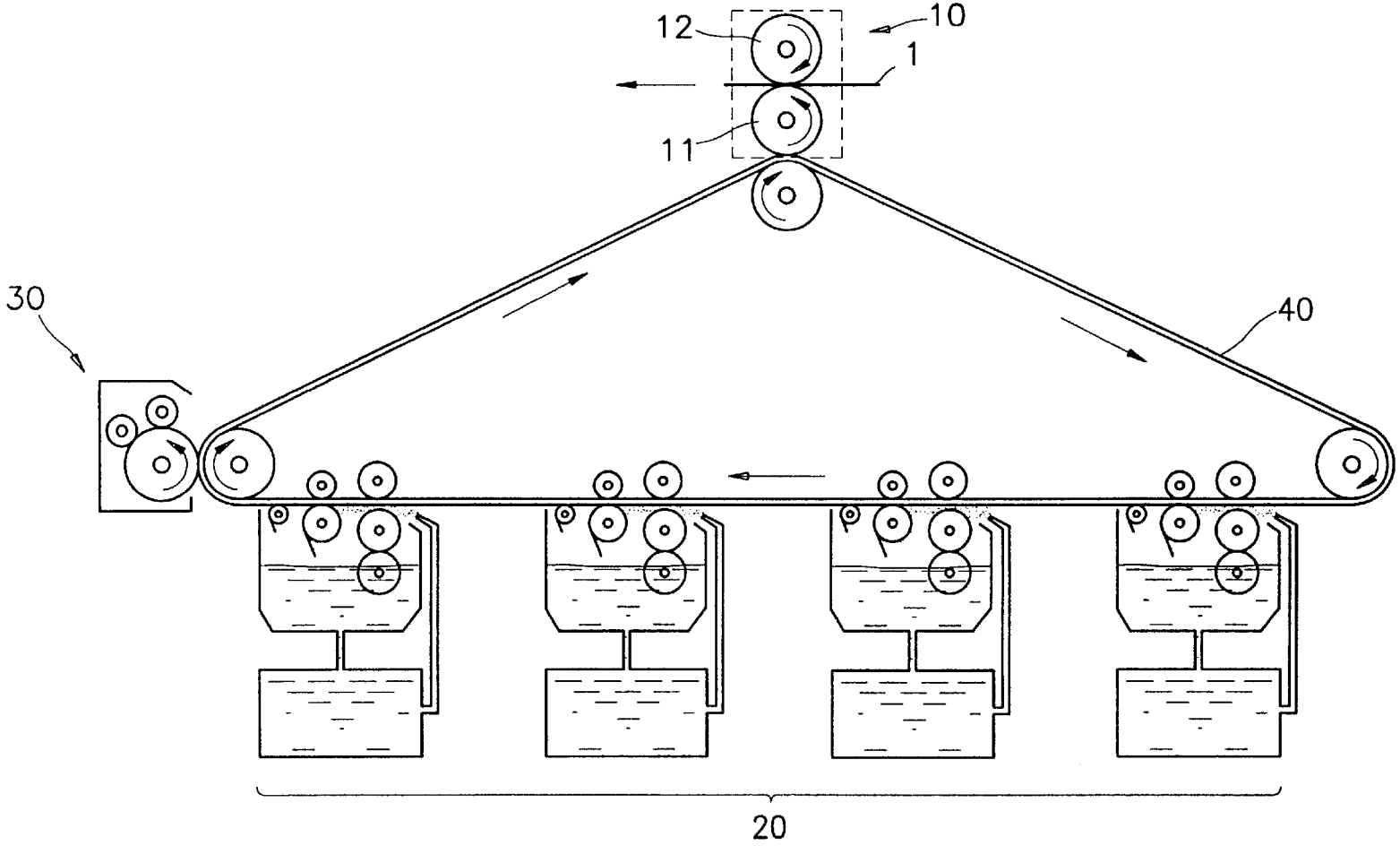

FIG. 2 *(Related Art)*
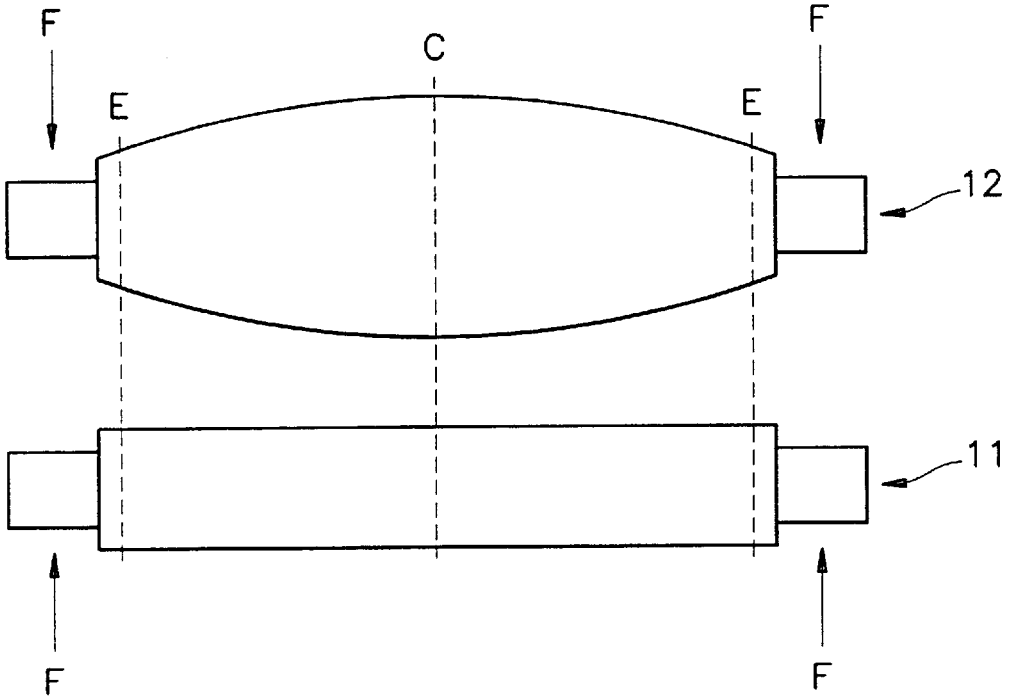
FIG. 3 *(Related Art)*
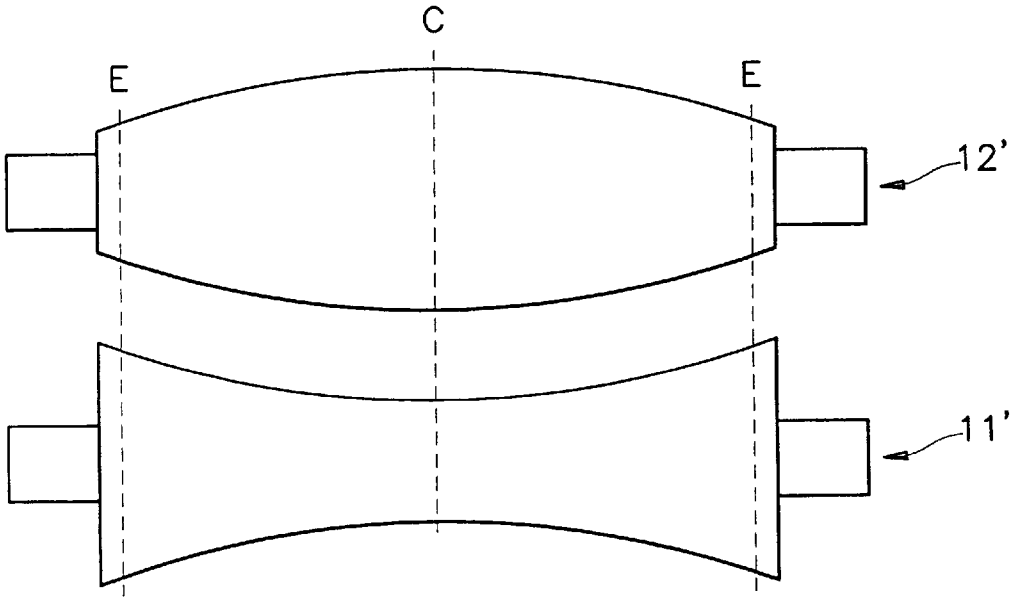

TRANSFER UNIT OF ELECTROPHOTOGRAPHIC PRINTER

CLAIM OF PRIORITY

This application makes reference to, incorporates the same herein, and claims all benefits accruing under 35 U.S.C. §119 from my application TRANSFER UNIT OF ELECTROPHOTOGRAPHIC PRINTER filed with the Korean Industrial Property Office on Sep. 19, 1998 and there duly assigned Ser. No. 38827/1998.

BACKGROUND OF THE INVETION

1. Field of the Invention

The present invention relates to a transfer unit of an electrophotographic printer, and more particularly, to a transfer unit of an electrophotographic printer in which a fuser roller and a transfer roller which print an image on a paper while pressing and passing the paper therebetween have improved structures.

2. Description of the Related Art

In general, an electrophotographic printer, such as a color laser printer, is provided with developing units for developing an electrostatic latent image formed on a photosensitive belt with a liquid developer, and a transfer unit for transferring the developed image on the photosensitive belt onto a paper. A drying unit evaporates and dries the liquid solvent of the liquid developer remaining on the photosensitive belt.

The transfer unit includes a transfer roller to which the developed image is transferred from the photosensitive belt and which prints the image on the contacting surface of the paper, and a fuser roller for pressing the paper toward the transfer roller. Therefore, the paper fed to the transfer unit passes through between the transfer roller and the fuser roller, i.e., a gap between the rollers, while being pressed by the rollers, and the image is printed on one surface of the paper.

However, since the transfer roller and the fuser roller have flat horizontal profile lines, the rollers bend when a paper is positioned between the rollers due to the pressing force between the rollers. That is, since the gap between the end portions of the rollers to which more pressing force is applied becomes relatively narrow, and the gap between the middle portion of the rollers becomes relatively wide, uniform pressure cannot be applied over the whole range of the paper. Of course, though the two rollers are in contact with each other and there is no substantially sensible gap between the rollers, the end portions of the rollers press the paper with a stronger force than the middle portions when the rollers bend.

In connection with the bending of the rollers as described above, rollers having special profiles have been proposed. The middle portion of a fuser roller may be is slightly bulged in comparison with the end portions. Therefore, the gap between the two rollers and can be horizontally straight and uniform when the rollers bend due to the pressing force therebetween. However, since there are linear velocity differences between the middle portion and end portions of the fuser roller when the roller rotates, the paper passing through between the two rollers and may be wrinkled or torn due to the linear velocity differences.

On the other hand, a fuser roller and a transfer roller having different profiles have been proposed. The fuser roller is formed to have a crowned profile in which the middle portion of the fuser roller is convex, and the transfer roller is formed to have a flared end profile in which the middle portion of the transfer roller is concave. That is, the fuser roller has a crowned shape, and the transfer roller has flared shapes at both ends. Therefore, the structures of the rollers as described above allow the widthwise gap by the pressing force between the two rollers to be uniform to some extent, and the difference in the linear velocities to be compensated for.

However, when a paper passes between the crowned roller and the flared roller, the result is an upward curl in which both sides of the paper are bent upward according to the shape of a nip between the rollers. In this case, since both sides of the printing paper are deformed in a rolled manner, there is an inconvenience in which the rolled paper must be flattened.

SUMMARY OF THE INVENTION

To solve the above problem, it is an objective of the present invention to provide a transfer unit of an electrophotographic printer in which the configurations of rollers are improved so that a uniform pressing force can be established between rollers, and a paper passing through between the rollers is prevented from being wrinkled or torn due to differences in linear velocities between the rollers and prevented from being curled or rolled.

Accordingly, to achieve the above objective, there is provided a transfer unit of an electrophotographic printer comprising a transfer roller and a fuser roller for pressing a paper passing through a gap therebetween and transferring an image onto the paper, wherein one of the two rollers has a shape having flared ends and a smaller diameter at the center portion thereof; and the other roller comprises a core portion having a crowned shape mating with the shape of the flared roller and a deformable portion which is provided around the core portion so as to form a circumferential surface having a straight profile line, and which is deformable so that a uniform gap between the two rollers can be formed.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein:

FIG. 1 is a schematic diagram illustrating the internal structure of an electrophotographic printer;

FIG. 2 shows profiles of a transfer roller and a fuser roller which are employed in the transfer unit shown in FIG. 1;

FIG. 3 shows profiles of another transfer roller and fuser roller which are employed in the transfer unit shown in FIG. 1.

DESCRIPTION OF THE PREFERRED EMBODIMENT

Figure 4:
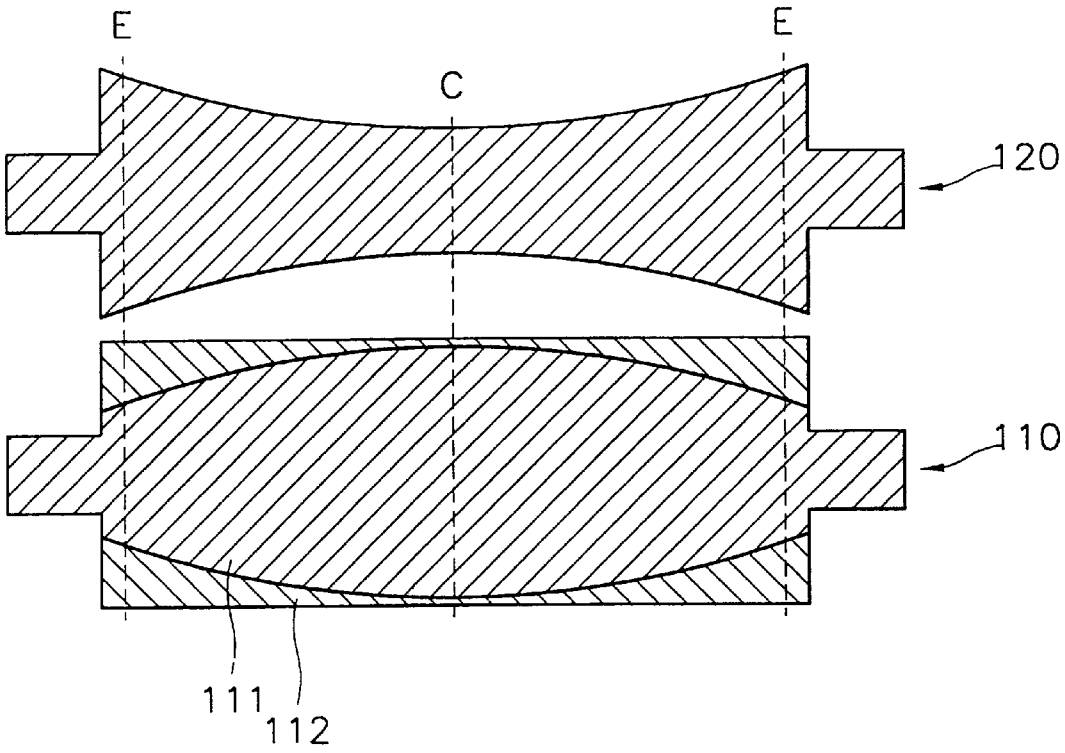
FIG. 4 shows profiles of a transfer roller and a fuser roller according to a preferred embodiment of the present invention, which can be employed in a transfer unit of an electrophotographic printer.

FIG. 1 illustrates an electrophotographic printer, such as a color laser printer as noted above in the Description of the Related Art. FIG. 1 shows developing units 20 a drying unit 30, a photosensitive belt 40, a transfer roller 11 and a fuser roller 12 which constitutes a transfer unit 10, paper 1 being fed between the transfer roller 11 and the fuser roller 12.

FIGS. 2 and 3 each illustrate rollers having a special profiles as noted above in the Description of the Related Art.

As illustrated in FIG. 2, when the rollers 11 and 12 are pressed together by the force F, there are linear velocity differences between the middle portion C and the end portions E.

On the other hands, as illustrated in FIG. 3, when the fuser roller 12' and the transfer roller 11' are pressed together, the difference in linear velocities between the middle portion C and the end portions E are somewhat compensated for. However, the rollers of FIG. 3 result in an upward curl of the paper passing therebetween.

FIG. 4 shows profiles of a transfer roller 110 and a fuser roller 120 according to a preferred embodiment of the present invention, which can be employed in a transfer unit of an electrophotographic printer.

Referring to FIG. 4, the fuser roller 120 is formed to have flared end profiles in which the middle portion C of the fuser roller 120 is concave. The fuser roller 120 has an aluminum hard roll coated with Teflon. The transfer roller 110 closely contacting the fuser roller 120 includes a crowned core portion 111 formed to have a crowned profile in which the middle portion C thereof is convex so as to mate with the profile of the fuser roller 120, and a deformable portion 112 surrounding the core portion 111. It is preferable that the core portion 111 is made of the same aluminum material as the fuse roller 120, and the deformable portion 112 is made of a deformable silicone rubber.

With the above structure, when the transfer roller 110 and the fuser roller 120 are pressed to contact each other, the deformable portion 112 which is relatively soft is pressed and deformed by the flared profile of the fuser roller 120 and a gap is formed when the core portion 111 mates with the profile of the fuser roller 120. At the center portion C, the pressing force between the transfer roller 110 and the fuser roller 120 becomes larger due to the shape of the core portion 111 so that an uniform pressing force can be exerted on an area from the end portions E to the center portion C between the transfer roller 110 and the fuser roller 120. In addition, a desired uniform gap can be formed by the interaction and deformation between the flared profile of the fuser roller 120 and the deformable portion 112. Consequently, the uniformity in linear velocities between the rollers 110 and 120 can be established by the uniform pressing force and the uniform gap.

In addition, when a paper passes through the gap formed by mating the core portion 111 with the profile of the fuser roller 120, the paper is subjected to less curling force at the end portions E thanks to the above silicone rubber layer, i.e., the elastically deformable portion 112. That is, since the deformable portion 112 is designed to form a uniform gap shape particularly at the end portions E, i.e., a uniform mating shape between the fuser roller 120 and the transfer roller 110, the curling tendency of a paper is reduced. Consequently, wrinkling and tearing of a paper due to the differences in linear velocities, and curling or waviness of a paper due to the mating shape of the rollers 110 and 120 can be prevented by establishing the uniform pressing force and the uniform gap between the rollers 110 and 120.

On the other hand, in the above-described embodiment, even though the fuser roller 120 has a flared profile and the transfer roller 110 has a crowned core portion 110, a similar effect can be obtained when the shape of the rollers 110 and 120 are reversed.

The above-described transfer unit of an electrophotographic printer according to the present invention has advantages in which wrinkling and curling of a paper can be suppressed by employing a crowned core portion and a silicone rubber layer.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A transfer unit of an electrophotographic printer comprising:

a transfer roller and a fuser roller for pressing a paper passing through a gap therebetween and transferring an image onto the paper;

one of the two rollers having a shape having flared ends and a smaller diameter at the center portion thereof; and the other of the two rollers comprising a core portion having a crowned shape mating with the shape of the roller having flared ends and a deformable portion which is provided around the core portion so as to form a circumferential surface having a straight profile line, and which is deformable so that a uniform gap between the two rollers can be formed.

2. The transfer unit of an electrophotographic printer as claimed in claim 1, the deformable portion comprising a silicone rubber.

3. The transfer unit of an electrophotographic printer as claimed in claim 1, the fuser roller comprising aluminum coated with teflon.

4. The transfer unit of an electrophotographic printer as claimed in claim 2, the fuser roller comprising aluminum coated with teflon.

5. The transfer unit of an electrophotographic printer as claimed in claim 1, the transfer roller comprising aluminum coated with teflon.

6. The transfer unit of an electrophotographic printer as claimed in claim 2, the transfer roller comprising aluminum coated with teflon.

7. The transfer unit of an electrophotographic printer as claimed in claim 3, the transfer roller comprising aluminum coated with teflon.

8. The transfer unit of an electrophotographic printer as claimed in claim 4, the transfer roller comprising aluminum coated with teflon.

* * * * *